US005223148A

United States Patent [19]

Tipman et al.

[11] Patent Number: 5,223,148

[45] Date of Patent: Jun. 29, 1993

[54] PROCESS FOR INCREASING THE BITUMEN CONTENT OF OIL SANDS FROTH

[75] Inventors: Robert N. Tipman; Varagur S. V. Rajan, both of Sherwood Park; Dean Wallace, Beaumont, all of Canada

[73] Assignee: Oslo Alberta Limited, Calgary, Canada

[21] Appl. No.: 790,888

[22] Filed: Nov. 12, 1991

[51] Int. Cl.[5] ..... B03D 1/10; C10G 33/08; C10G 1/00

[52] U.S. Cl. ..... 210/744; 210/774; 210/804; 208/390; 208/391; 208/425; 209/164; 209/168

[58] Field of Search ..... 209/164, 168, 10; 208/390, 391, 425; 196/14.52; 210/744, 703, 221.2, 774, 114, 804; 55/36, 87, 178

[56] References Cited

U.S. PATENT DOCUMENTS

| | | | |
|---|---|---|---|
| 3,296,117 | 1/1967 | Ross | 208/391 |
| 3,331,765 | 7/1967 | Canevari | 208/391 |
| 3,553,100 | 1/1971 | Jorda | 208/425 |
| 3,607,721 | 9/1971 | Nagy | 208/425 |
| 3,738,930 | 6/1973 | Kaminsky | 208/391 |
| 3,808,120 | 4/1974 | Smith | 208/391 |
| 4,035,282 | 7/1977 | Stuchberry | 208/391 |
| 4,116,809 | 9/1978 | Kizior | 208/391 |
| 4,648,964 | 3/1987 | Leto | 208/391 |
| 4,859,317 | 8/1989 | Shelfantook | 208/425 |
| 5,118,408 | 6/1992 | Jansen | 208/391 |

FOREIGN PATENT DOCUMENTS

| | | | |
|---|---|---|---|
| 630710 | 11/1961 | Canada | 208/425 |
| 675507 | 12/1963 | Canada | 208/425 |
| 857306 | 12/1970 | Canada | 208/425 |
| 1081641 | 7/1980 | Canada | 208/425 |
| 1152918 | 8/1983 | Canada | 208/391 |
| 1267860 | 4/1990 | Canada | 208/390 |
| 2097689 | 11/1982 | United Kingdom | 210/744 |

*Primary Examiner*—Thomas M. Lithgow
*Attorney, Agent, or Firm*—Arne I. Fors

[57] ABSTRACT

A process and an apparatus are described for separation of water and solids from oil sands froth in which heated froth is fed into a gravity settling vessel at a level below a bitumen-water interface established between a bitumen froth layer floating on a quiescent body of water whereby water and solids contained in the froth separate from the froth stream, the oil rises to accumulate in the bitumen froth layer, and the solids fall by gravity to the bottom of the gravity settling vessel. The apparatus comprises an injector manifold suspended horizontally within the vessel below the bitumen-water interface, said injector manifold having a plurality of equispaced, inwardly facing openings for the inward discharge of oil sands froth into the body of water. The injector ring manifold may also have a plurality of outwardly facing openings for both inward and outward discharge of froth. A level probe for monitoring the level of the bitumen-water interface preferably is mounted in the vessel in electrical communication with a valve for discharging underflow for control of the level of the bitumen-water interface.

8 Claims, 6 Drawing Sheets

PROCESS FOR INCREASING THE BITUMEN CONTENT OF OIL SANDS FROTH

FIELD OF THE INVENTION

This invention relates to a process for separating oil as bitumen from oil sands and, more particularly, relates to a process for beneficiating bituminous froths by removal of water and solids.

BACKGROUND OF THE INVENTION

The commercial extraction of oil as bitumen from oil sands involves the use of the "hot water" process in which mined oil sands typically are introduced into a rotating drum and slurried with steam and hot water at approximately 80° C. The drum discharge, freed from rocks and clay lumps by screening, is further diluted with hot water to about 50% solids and a temperature of about 70° to 75° C., and pumped into a process vessel for the initial separation of bitumen from the oil sand slurry and recovery of bitumen as a primary froth product. The slurry discharged from the bottom of this vessel, and the middlings from an intermediate zone, are either further processed separately or combined and then processed by air flotation to recover additional bitumen from these streams. The flotation of bitumen in one or more vessels is termed a secondary recovery process. A sand-water slurry discharged from the bottom of these vessels becomes tailings and is discarded.

In secondary recovery processes, air is introduced into the slurry and the subsequent flotation of the bitumen yields a lower grade froth which contains higher contents of water and solids than obtained from the initial, or primary separation. The secondary froths are then combined into a settling vessel or "cleaner" where some of the excess water and solids are removed. Secondary froth is combined with primary froth to become the overall bituminous froth product. The cleaner bottoms slurry is returned to the flotation circuit.

The term "solids" used herein refers to inorganic solids such as fine quartz sand and silt and clay minerals.

In the commercial processes, bituminous froths produced in the secondary recovery circuit contain significant amounts of residual water and solids, e.g. 60 to 80% water and 5 to 10% solids. At the process temperature, solids and water partially separate from the bitumen resulting in a secondary bituminous froth containing approximately 30–35% bitumen, 50–55% water and 10–20% solids. This froth is combined with the primary froth which contains approximately 65% bitumen, 25% water and 10% solids. Combining the secondary froth stream with the primary stream results in the overall bituminous froth product.

In subsequent treatment of this froth, water and solids are further removed by dilution of the froth with a diluent solvent such as naphtha. This diluted bitumen is treated by centrifugation in the commercial process to remove water and solids. A reduction in the water and solids content of the froth would result in higher capacities in the centrifugation process and reduction in the hydrocarbon losses to the slurry.

Canadian Patent No. 857,306 issued on Dec. 1, 1970 to Dobson discloses the treatment of middlings by flotation to produce an aerated scavenger froth which is passed to a settling zone for separation of mineral matter from the froth. The separation occurs at the ambient temperature of the froth, normally 70°–75° C.

U.S. Pat. No. 3,338,814 issued on Aug. 29, 1967 to Given et al. describes a process whereby froths produced by hot water extraction of bitumen are dehydrated by heating to temperatures from 225° to 550° F. (preferably 350° to 450° F.). The dehydrated bitumen, containing 5% to 25% solids is then subjected to cycloning or filtration to remove solids. In a variation to the basic process, a light hydrocarbon can be added to the dry bitumen to improve the filtration step. The hydrocarbon can be recovered by distillation and recycled. This is essentially a two-stage process that requires a considerable amount of energy in order to obtain a satisfactory degree of water and solids removal.

U.S. Pat. No. 3,901,791 issued on Aug. 25, 1975 to Baillie discloses a method for upgrading bituminous froth by diluting the froth with a hydrocarbon diluent boiling in the range of 350° to 750° F., heating the diluted froth to a temperature in the range of 300°–1000° F. and settling the froth in an autoclave at a pressure in the range of 0 to 1000 psig, diluting settled tailings with the diluent and centrifuging the diluted tailings to provide a centrifugal froth.

U.S. Pat. No. 4,035,282 issued on Jul. 12, 1977 to Stuckberry et al. discloses a process for recovery of bitumen from a bituminous froth in which the froth is diluted with a hydrocarbon solvent and subjected to a two-stage centrifugation for removal of water and minerals. Solvent is added before each stage of centrifugation.

U.S. Pat. No. 4,648,964 issued on Mar. 10, 1987 to Leto et al. discloses a process for separating the hydrocarbon fraction from a tar sands froth in which the froth is pressurized to about 1000 psig and heated to about 300° C. to enhance gravity separation, and the constituents separated at a reduced pressure.

U.S. Pat. No. 4,859,317 issued on Aug. 22, 1989 to Shelfantook et al. proposes three stages of inclined plate settlers to remove water and solids from bitumen froths. This process is carried out at approximately 80° C. using naphtha as diluent in a 1:1 volume ratio based on the oil content in the froth.

Canadian Patent 915,608 issued on Nov. 28, 1972 to Clark et al. describes a process for removing water from a bituminous froth by imparting shearing energy to thereby coalesce water from at least 25 pounds of water per 100 pounds of bitumen to less than about 15 pounds of water per 100 pounds of bitumen. The process was carried out at temperatures between about 35° to 49° C.

The processes disclosed in the foregoing patents are complex and necessitate the use of expensive solvents or require high temperatures and/or pressures in an effort to beneficiate the bitumen froth.

It is the principal object of the present invention to provide a simple process and an apparatus for reducing water and inorganic solids from bituminous froths without the use of solvents.

Commercial extraction processes use water heated to a nominal temperature of about 70° to 75° C. Recent development work is aimed at reducing this processing temperature as low as 10° C. to achieve energy savings and reductions in processing costs. However, reductions in processing temperature have the undesirable consequence of increasing the solids content in the froth products, thereby placing more emphasis on the development of froth cleaning processes to improve froth quality. In addition, froths produced at these low temperatures are extremely viscous and difficult to process.

It is another object of the present invention to provide a process and an apparatus to enable the production of high grade froth products from lower temperature oil sands extraction processes.

SUMMARY OF THE INVENTION

In its broad aspect, the present invention relates to a process for improving the quality of froth derived from the extraction of bitumen from oil sands in which effective separation of water and solids is achieved by heating lower quality froth products to a temperature in the range of 80° to 100° C. The heated froth is fed into a gravity settling vessel at a level below a bitumen-water interface between a froth layer floating on a quiescent body of water whereby water and solids contained in the froth separate from the froth stream, and the oil rises to accumulate in a bitumen-enriched overflow stream. The solids fall by gravity to the bottom of the gravity settling vessel.

The apparatus of the invention for the removal of solids from a bituminous froth comprises, in combination, a vessel having a perimeter wall and a cone bottom for receiving a bituminous froth containing bitumen, solids and water whereby the bituminous froth forms a froth layer floating on a quiescent body of water defining a bitumen-water interface, means for discharging bituminous froth as an overflow and water containing solids as an underflow from the vessel, an injector manifold suspended horizontally within the vessel and below the bitumen-water interface, said injector manifold having a plurality of equispaced, inwardly facing openings formed therein for the inward discharge of bituminous froth into the body of water, and conduit means in communication with the injector manifold for feeding bituminous froth to the injector manifold.

The vessel preferably has a cylindrical perimeter wall and said injector manifold preferably is a ring manifold suspended horizontally within the vessel concentric with the vessel wall. The injector ring manifold may have a plurality of equispaced, inwardly and outwardly facing openings formed therein for the radially inward and outward discharge of bituminous froth into the body of water. A level probe preferably is mounted in the vessel in electrical communication with the means for discharging the water containing solids as an underflow for detecting the level of the bitumen-water interface whereby the level of the bitumen-water interface can be controlled by controlling the rate of discharge of the underflow.

DESCRIPTION OF THE PREFERRED EMBODIMENT

Figure 1:
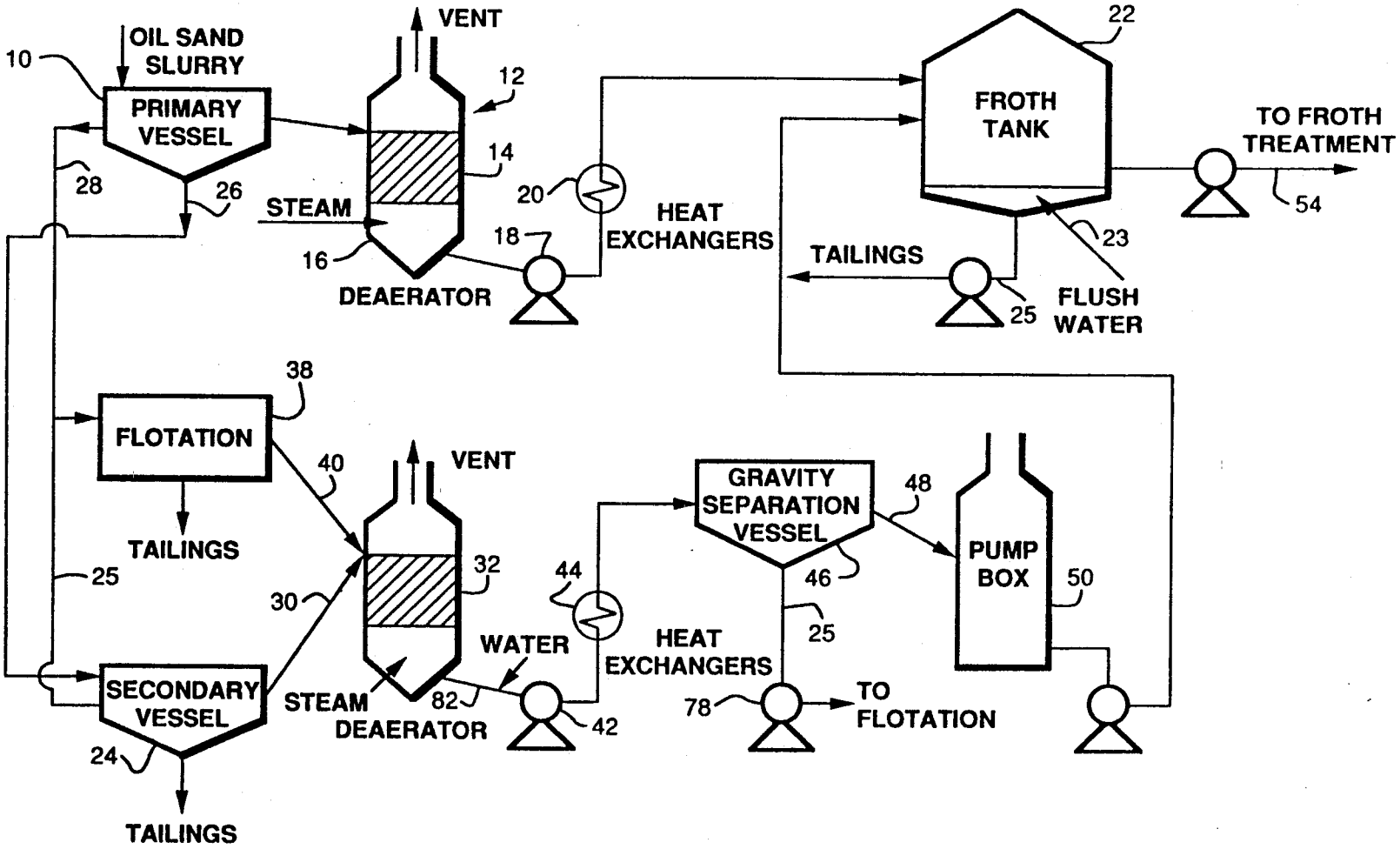
FIG. 1 is a schematic flow sheet of an embodiment of the process of the invention.

With reference to the schematic flowsheet of FIG. 1, primary froth from primary vessel gravity separator 10 normally containing 10 to 20% by volume air are partly deaerated in tower 12 having a structured packing 14, well known in the art. Froth flowing into the top of the tower 12 is distributed as falling droplets throughout the tower by the grid packing. Steam is introduced from below the grid near the bottom of the tower at 16 resulting in heating and deaerating of the descending froth droplets. The inlet froth temperature can range from less than 10° C. to about 70° C. The froth temperature at the deaerator outlet can range from 60° to 85° C. depending on the flow rates of froth and steam to the deaerator, the preferred temperature being from 65° to 75° C.

The heated froth is then pumped by pump 18 through a heat exchanger 20 to further increase the temperature to the range of 85° to 100° C., preferably about 90° C.

It will be understood that although cold froth can be heated from the process temperature to approximately 90° C. in a single stage by either direct steam contact in the deaerator 12 or by indirect heating with a heat exchanger 20, these two methods individually do not appear optimum for a large scale commercial operation. Heating of froth by direct steam contact is inefficient when the final froth temperature rises above 80° C. Heat exchangers are difficult to operate with cold froths which have extremely high viscosities in the temperature range of 0° to 50° C.

The middlings 28 from primary vessel gravity separator 10 are passed to flotation cell 38 for air flotation of bitumen and depression of solids. The float product 40 is passed to deaerating tower 32 and settled solids discharged as tailings. The tailings 26 from primary vessel 10 are passed to secondary vessel gravity separator 24 which is in series therewith, the settled solids discharged as tailings and the middlings 25 passed back to flotation cell 38 in which air flotation produces float product 40. This is combined with float product 30 temperature in the range of 60° to 85° C. for deaeration. The deaerated froth is pumped by pump 42 through heat exchanger 44 and heated to about 90° C. before introduction into gravity separation vessel 46, to be described, for cleaning of solids and water from the froth. The concentrated froth overflow 48 passes to pump box 50 and is pumped to froth tank 22 where it is combined without froth from heat exchanger 20 and the froth product 54 pumped to a froth treatment. Settled solids can be flushed with water 23 and solids and water discharged as tailings 25.

Figure 2:
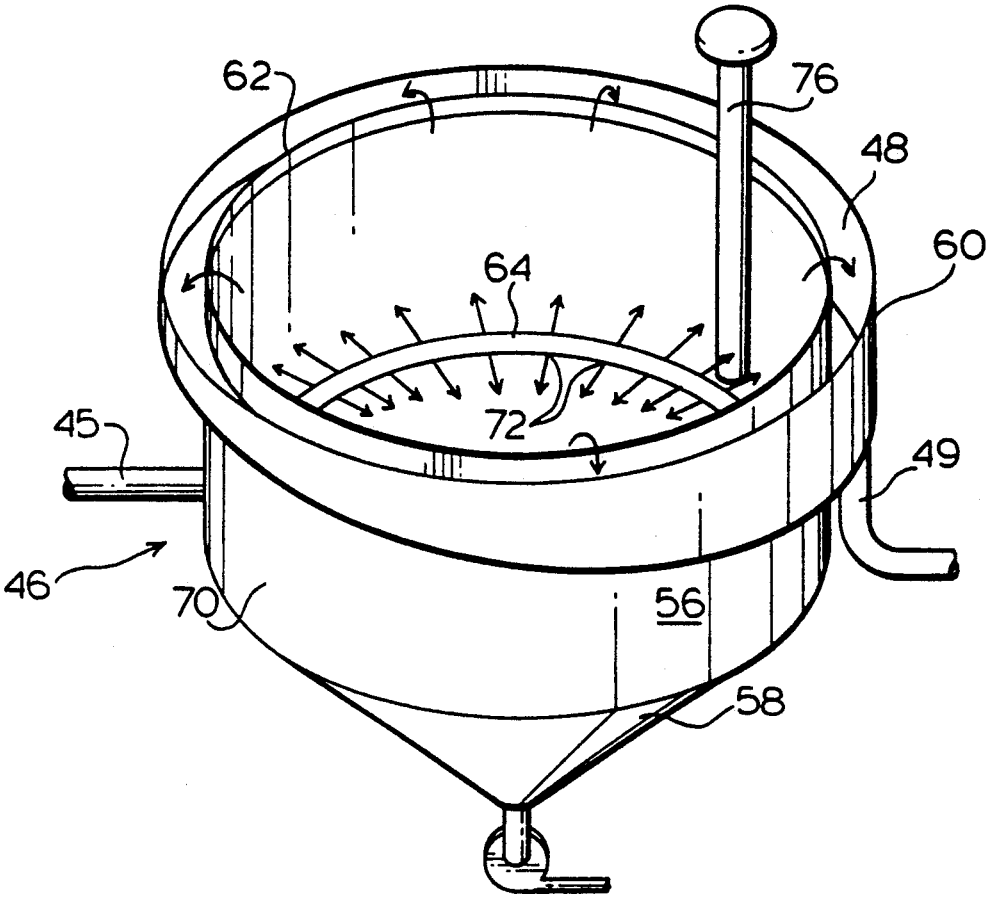
FIG. 2 is a perspective view of an embodiment of an apparatus of the present invention.
Figure 3:
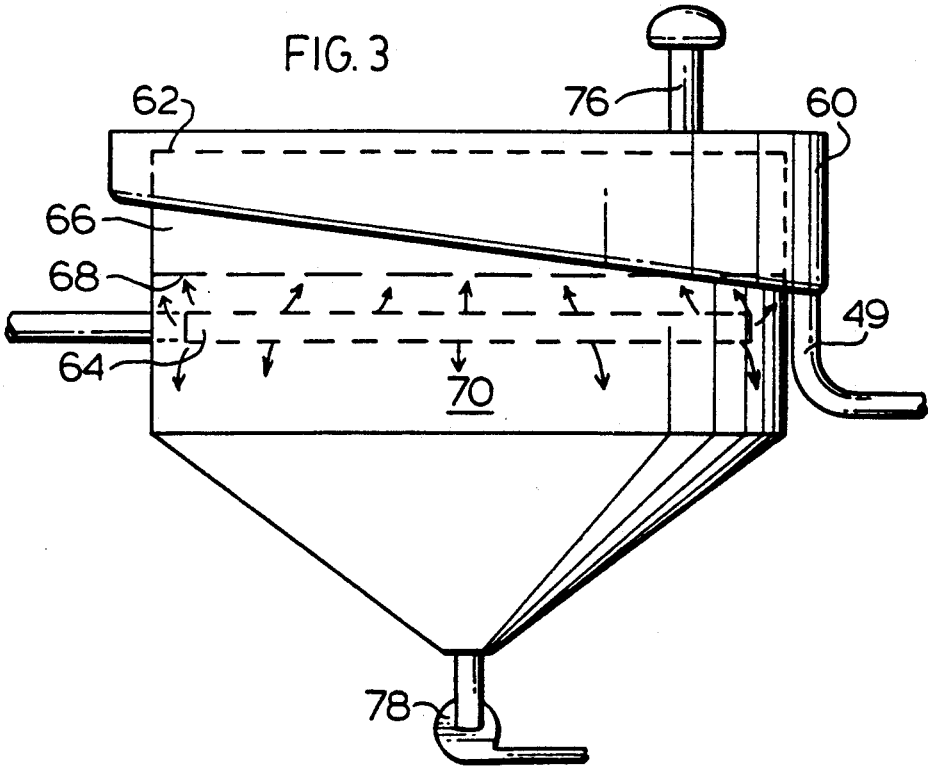
FIG. 3 is a side view of the apparatus shown in FIG. 2.
Figure 4:
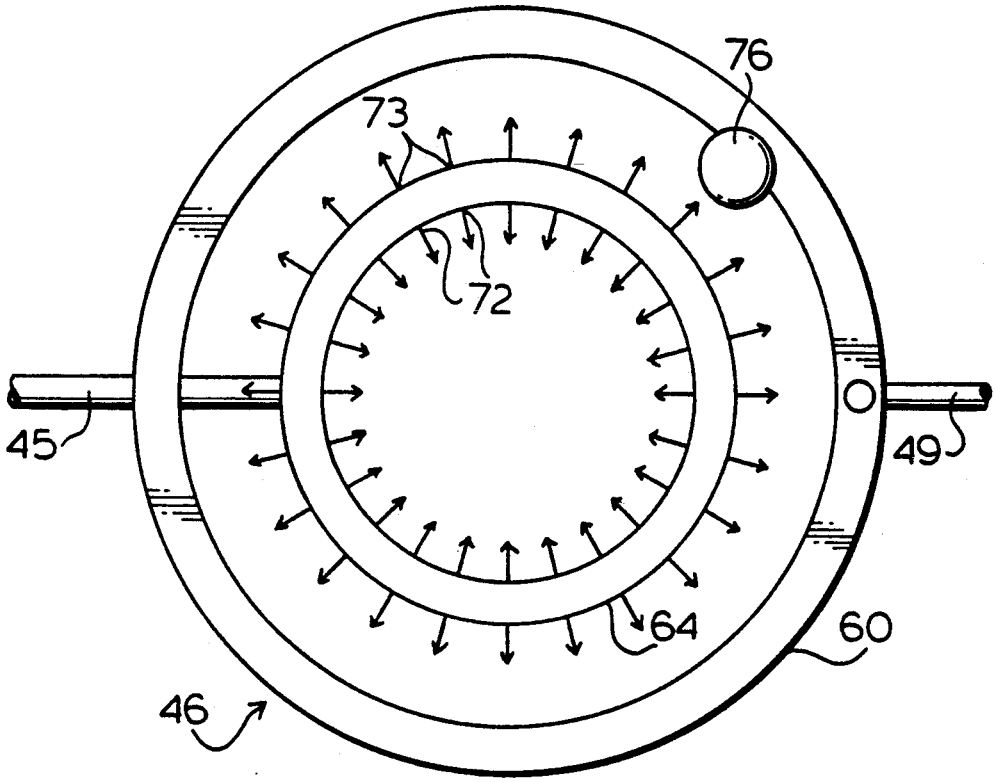
FIG. 4 is a plan view of said apparatus of the invention.

With reference now to FIGS. 2–4, separation vessel 46 comprises cylindrical wall 56 with cone bottom 58. Peripheral trough 60 surrounding rim 62 is adapted to receive froth overflow 48 for discharge through conduit 49 to pump box 50 and to a froth storage tank.

Injector ring conduit 64 in communication with feed pipe 45 from heat exchanger 44 is suspended horizontally within vessel 46 concentric with wall 56 below bitumen froth layer 66 preferably to between 2 and about 12 inches from interface 68 defined between froth layer 66 and quiescent body of water 70.

Injector ring conduit 64 has a plurality of equispaced, inwardly and outwardly facing openings 72, 73 formed therein for the radially inward and outward discharge of heated froth from heat exchanger 44 into quiescent body of water 70. The level of interface 68 is monitored by a level probe 76 which controls the speed of variable speed discharge pump 78 to maintain the interface at the desired level.

The bitumen phase in the stream of incoming bituminous froth heated to about 90° C. and introduced into body of water 70 rises to the interface 68 and coalesces with froth layer 66.

A significant portion of the water and solids introduced with the froth remains in the body of water for effective removal from the froth. Additional drainage of water and solids from the bitumen phase further enhances the quality of the bituminous froth.

It has also been found that the addition of water to the suction 82 of pump 42 (FIG. 1) to dilute and mix the froth prior to discharge into vessel 46, such as by mixing froth in centrifugal pump 42 followed by heating in heat exchanger 44 prior to discharge of the froth into the quiescent body of water in vessel 46 by injector ring 64, surprisingly results in enhanced removal of water and separation of solids from the froth. One purpose of the mixing referred to above, with or without the addition of water, is therefore to promote coalescence of small droplets of water into larger water particles which settle faster; effective mixing prior to settling is designed to achieve this.

Although the description has proceeded with reference to a cylindrical vessel with a ring manifold, it will be understood that the shape of vessel and manifold is not critical and the vessel configuration can, for example, be rectangular, such as a square, with a compatible manifold shape.

The process of the invention will now be described with reference to the following non-limitative examples.

Bituminous froth was supplied to direct and indirect steam heaters by an experimental extraction pilot plant of the type shown in FIG. 1 operating at a feed temperature between 45° and 60° C. The heated froth was passed into a cleaning vessel 46 for reduction of solids and water content in the froth. The direct heater was a tower 32 containing a structured packing 14 and indirect heating was provided by a heat exchanger 44. Either of the pilot plant heaters 32 or 44 was capable of heating froth to 90° C. and the effectiveness of each type of heater could be tested separately. Examples of hydrocarbon separation tests for each of the heating methods are given by the following examples.

EXAMPLE 1

Bituminous froth at an initial temperature of 70° C. was heated to about 91° C. by direct steam contact in deaerator 32 and then passed directly to a separation vessel 46. Separation results are shown in Table 1.

TABLE 1

| | Rate (kg/hr) | Temp. (°C.) | % Bitumen | % Water | % Solids | % Bitumen Distribution |
|---|---|---|---|---|---|---|
| Separator Feed | 583.2 | 91 | 32.4 | 51.5 | 16.2 | 100.0 |
| Separator Overflow | 340.5 | 91 | 54.2 | 38.1 | 9.5 | 94.5 |
| Separator Underflow | 242.7 | 91 | 4.4 | 70.2 | 25.5 | 5.5 |

EXAMPLE 2

Bituminous froth at an intial temperature of 48° C. was heated to about 88° C. by indirect steam heating in heat exchanger 44 and then passed directly to a separation vessel 46. Separation results are shown in Table 2.

TABLE 2

| | Rate (kg/hr) | Temp. (°C.) | % Bitumen | % Water | % Solids | % Bitumen Distribution |
|---|---|---|---|---|---|---|
| Separator Feed | 442.7 | 88 | 35.8 | 53.2 | 11.0 | 100 |
| Separator Overflow | 245.4 | 88 | 58.5 | 30.2 | 11.3 | 90.6 |
| Separator Underflow | 197.3 | 88 | 7.7 | 81.8 | 10.5 | 9.4 |

Substantial improvements in bituminous froth quality were obtained independent of the type of heating used.

Figure 5:
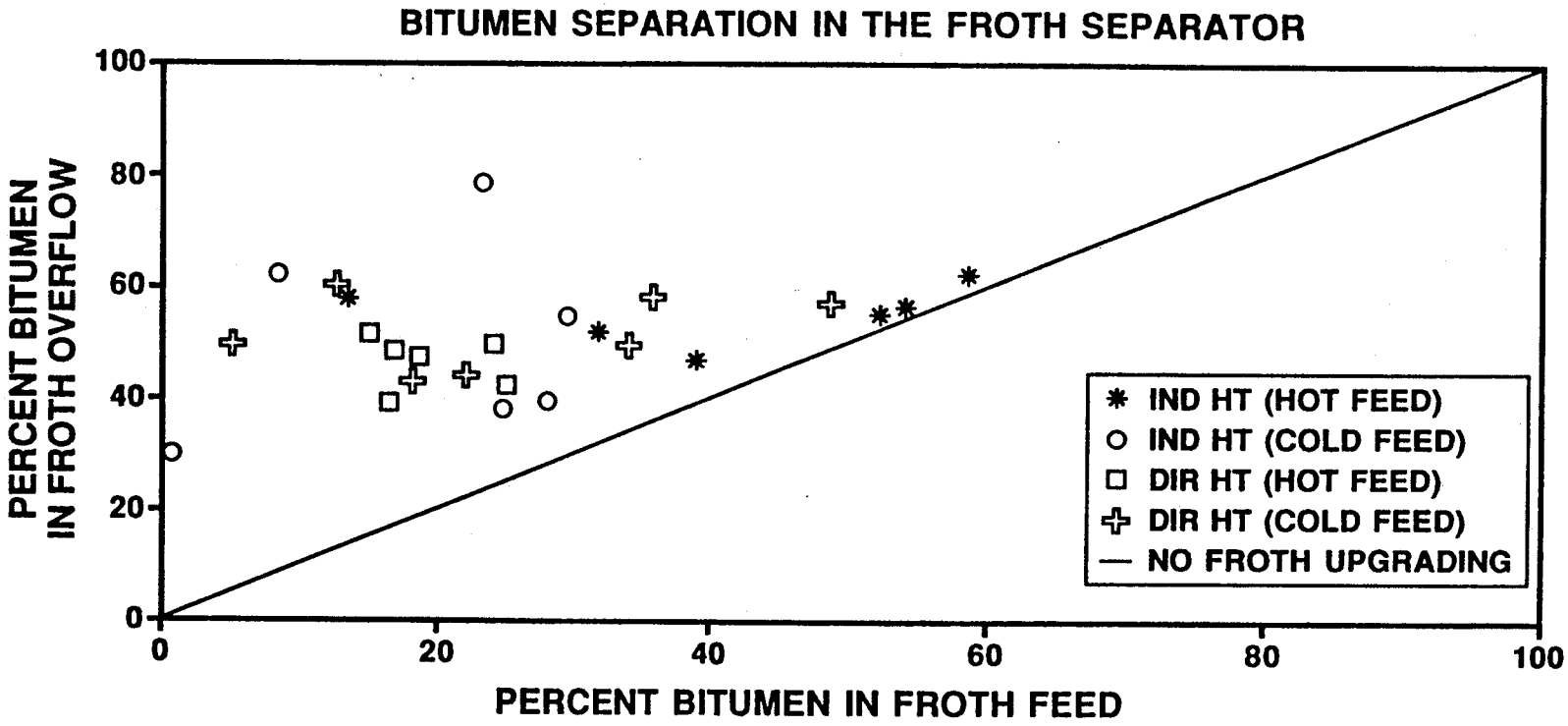
FIG. 5 is a graph showing bitumen separation in heated froth.

FIG. 5 illustrates the performance of the process of the invention for froths heated to 90° C. and containing bitumen in amounts of 10% to 60% by weight of froth in the feed to the froth cleaner 46. A surprising upgrade of bitumen from as low as 10% by weight to the range of 40% to 60% by weight, with an average bitumen content of about 50% by weight, was obtained.

Figure 6:
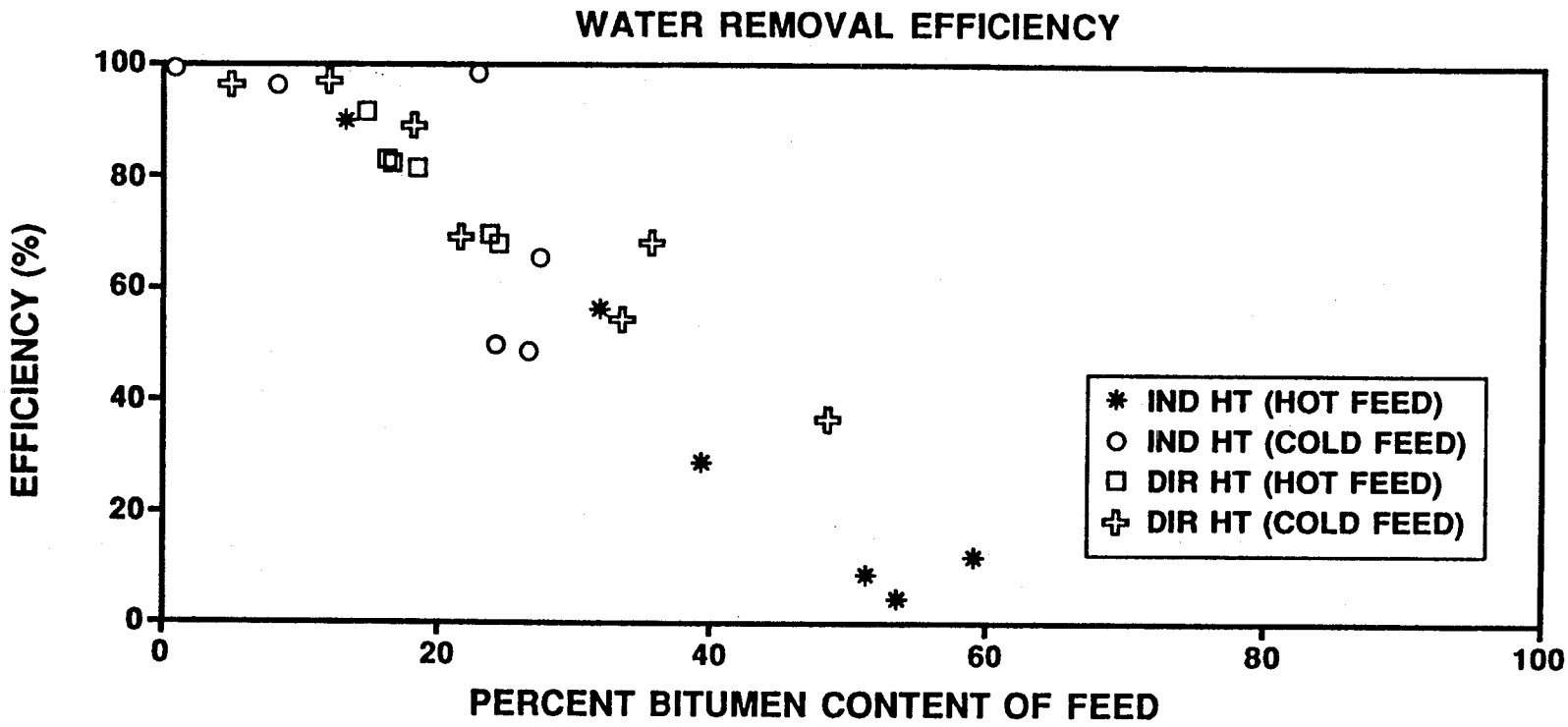
FIG. 6 is a graph showing efficiency of water removal.
Figure 7:
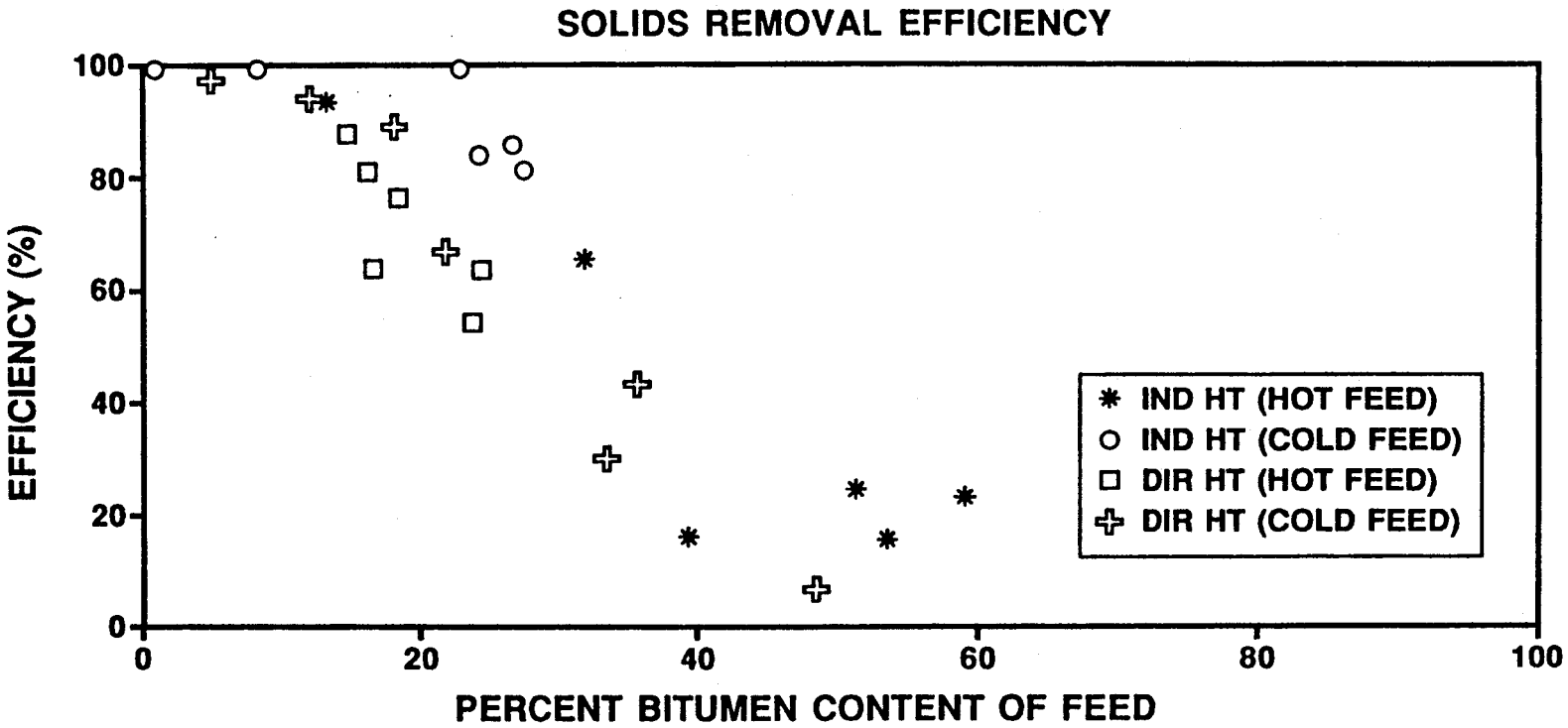
FIG. 7 is a graph showing efficiency of solids removal.

A comparison of FIGS. 6 and 7 indicates that the efficiency of water and solids removal from the heated froth was dependent on the water content of the froth; i.e. the lower the bitumen content and hence the greater the water content, the greater was the removal of water and solids. No significant improvement of bitumen content was obtained in froths exceeding 60% by weight bitumen.

It will be understood, of course, that modifications can be made in the embodiment of the invention illustrated and described herein without departing from the scope and purview of the invention as defined by the appended claims.

We claim:

1. A process for the removal of solids and water from a feed bituminous froth containing bitumen, solids and water in a gravity settling vessel have an existing bituminous froth layer floating on a quiescent body of water defining a bitumen-water interface therebetween comprising the steps of heating the feed bituminous froth to a temperature in the range of 85° to 100° C., feeding the heated froth into the body of water at a level below the bitumen-water interface whereby water and solids contained in the feed froth separate from the froth and the bitumen rises to accumulate in the existing bituminous froth layer, discharging solids-containing underflow from the vessel, monitoring the level of the bitumen-water interface and controlling the discharge of solids-containing underflow responsive to the monitoring of the bitumen-water interface at a rate such that the said interface is maintained at an effective level above the level at which the feed bituminous froth is fed into the body of water, and recovering a bitumen-enriched layer as an overflow.

2. A process as claimed in claim 1, further comprising maintaining the bitumen-water interface between 2 and about 12 inches above the level at which the feed bituminous froth is fed into the body of water.

3. A process as claimed in claim 2 in which the feed froth is heated to a temperature in the range of about 65° to 75° C. by direct contact of the feed bituminous froth with steam and the feed bituminous froth is heated to a temperature in the range of about 85° to 100° C. by indirect heating by a heat exchanger.

4. A process as claimed in claim 1 in which the vessel has a circular perimeter and feeding the heated froth into the body of water radially about the perimeter of the vessel.

5. A process as claimed in claim 1 further comprising adding water to the feed bituminous froth and mixing the water with the feed froth before feeding the froth into the body of water within the gravity settling vessel.

6. A process as claimed in claim 5 further comprising efficient mixing of the feed froth before feeding the froth into the body of water within the gravity settling vessel.

7. A process as claimed in claim 6 in which the feed froth is heated to a temperature in the range of about 65° to 75° C. by direct contact of the bituminous froth with steam and the bituminous froth is heated to a temperature in the range of about 85° to 100° C. by indirect heating by a heat exchanger.

8. A process as claimed in claim 1 further comprising efficient mixing of the feed froth before feeding the froth into the body of water within the gravity settling vessel.

* * * * *